US011296455B1

(12) United States Patent
Lin

(10) Patent No.: US 11,296,455 B1
(45) Date of Patent: Apr. 5, 2022

(54) WATERPROOF CIRCULAR CONNECTOR

(71) Applicant: P-TWO INDUSTRIES INC., Taoyuan (TW)

(72) Inventor: Hsien-Chang Lin, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 17/185,889

(22) Filed: Feb. 25, 2021

(30) Foreign Application Priority Data

Oct. 23, 2020 (TW) ..... 109137215
Nov. 10, 2020 (TW) ..... 109139516

(51) Int. Cl.
*H01R 13/52* (2006.01)

(52) U.S. Cl.
CPC ..... *H01R 13/5219* (2013.01); *H01R 13/5202* (2013.01); *H01R 13/5208* (2013.01)

(58) Field of Classification Search
CPC ..... H01R 13/5219; H01R 13/5202; H01R 13/5208; H01R 12/52; H01R 12/716
See application file for complete search history.

(56) References Cited

U.S. PATENT DOCUMENTS 9,055,686 B2 * 6/2015 Tanaka ..... H05K 1/144
10,340,644 B1 * 7/2019 Lee ..... H01R 24/86
10,594,072 B2 * 3/2020 Lim ..... H01R 13/04
10,630,021 B2 * 4/2020 Shiraishi ..... H01R 13/6315

* cited by examiner

*Primary Examiner* — Tho D Ta
(74) *Attorney, Agent, or Firm* — Fei-hung Yang

(57) ABSTRACT

A waterproof circular connector includes a male head, a female seat and a ring member. The male head provides a first circular body, a third circular body, a first electrode group and a third electrode group. The female seat provides a first base, a second circular body, a fourth circular body, a second base, a second electrode group and a fourth electrode group. The male header is combined with the female seat. The third circular body is inserted between the second and fourth circular bodies, so that the third electrode group is electrically connected to the second electrode group and the first electrode group is electrically connected to the fourth electrode group. The first, second, third and fourth electrode groups are combined with the third circular body by the ring member to prevent water and dust entering from the outside and realize non-directional electrical connections.

9 Claims, 9 Drawing Sheets

WATERPROOF CIRCULAR CONNECTOR

CROSS-REFERENCE TO RELATED APPLICATIONS

This non-provisional application claims priority under 35 U.S.C. § 119(a) on Patent Application No(s). 109137215 filed in Taiwan, R.O.C. on Oct. 23, 2020, and on Patent Application No(s). 109139516 filed in Taiwan, R.O.C. on Nov. 10, 2020, the entire contents of which are hereby incorporated by reference.

BACKGROUND

Technical Field

The present invention relates to the technical field of connectors. More particularly, the present invention relates to a waterproof circular connector with the feature of non-directional electrical connections.

Description of Related Art

In general, a conventional connector includes a male head and a female seat, and the male head is combined with the female seat within the range of an operator's sight to achieve the effect of transmitting power and signals. In some special cases, the technology of a circular connection patented by the inventor of the present invention can be used for blind insertions to prevent the male head and the female seat from being damaged when the male head is inserted into the female seat hastily by an operator, and the incorrect insertion may even cause damages to an electronic product.

Although such circular connector can overcome the issue of the conventional connector, the design of the circular connector comes with several terminals (or electrodes), and the gaps between terminals are very tight, so that water and dust entering from the outside may cause signal errors or short circuits easily.

In view of the aforementioned drawback of the conventional connector, the present invention provides a waterproof circular connector to overcome the drawback of the conventional connector.

SUMMARY

Therefore, it is a first objective of the present disclosure to provide a waterproof circular connector to overcome the drawback of the prior art.

To achieve the foregoing and other objectives, the present invention discloses a waterproof circular connector comprising a male head and a female seat that can realize a non-directional blind-insertion connection.

A second objective of the present invention is to provide a ring member installed to the female member based on the aforementioned waterproof circular connector, so as to achieve the dustproof and waterproof effect.

A third objective of the present invention is to provide an outer casing with a pressing strip based on the aforementioned waterproof circular connector, and the pressing strip is provided for pressing the ring member to enhance the dustproof and waterproof effects.

A fourth objective of the present invention is to provide a male head with a rib ring surrounding around the first circular body and disposed proximate to the outer periphery of the third circular body based on the aforementioned waterproof circular connector to achieve the dustproof and waterproof effects.

A fifth objective of the present invention is to provide a first positioning structure disposed at the inner periphery of the third circular body of the male head and a second positioning structure disposed at the outer periphery of the fourth circular body of the female seat based on the aforementioned waterproof circular connector, and the first positioning structure is combined with the second positioning structure, and the male head is coupled to the female seat with a predetermined angle to achieve the effect of blind insertion.

A sixth objective of the present invention is to provide a ring structure to both of the male head and the female seat based on the aforementioned waterproof circular connector, and each ring structure provides a corresponding electrode group, so that the combination of the ring structures allows the electrode groups to realize the transmission of power and/or control signals between the male head and the female seat.

A seventh objective of the present invention is to provide a design based on the aforementioned waterproof circular connector for adjusting the quantity of electrode groups provided by the ring structures according to actual product requirements.

An eighth objective of the present invention is to provide a design based on the aforementioned waterproof circular connector and allow the electrode groups of each ring structure to perform transmissions of control signals and/or power independently, or to perform transmissions of control signals and power simultaneously in a plurality of ring structures.

A ninth objective of the present invention is to provide a design based on the aforementioned waterproof circular connector that allows the quantity of electrodes of the electrode groups provided by each of the ring structures to be equal or unequal, and the electrode groups of the ring structures to be symmetrically or asymmetrically configured.

A tenth objective of the present invention is to apply the aforementioned waterproof circular connector in the areas of display devices, cars, or any other area that requires an electrical connection.

To achieve the aforementioned and other objectives, the present invention discloses a waterproof circular connector applied to a first circuit board and a second circuit board. The waterproof circular connector comprises a male head, a female seat and a ring member. The male head is capable of coupling the first circuit board. The male head comprises a first circular body, a third circular body, a first electrode group and a third electrode group. The third circular body is stacked on the first circular body. The female seat is capable of coupling the second circuit board. The female seat comprises a first base, a second circular body, a fourth circular body, a second base, a second electrode group and a fourth electrode group. The second base, the fourth circular body, the second circular body and the first base are arranged sequentially from a center point of the female seat to the outside, and the second electrode group is disposed between the first base and the second circular body, and the fourth electrode group is disposed between the fourth circular body and the second base. The ring member comprises a buckle portion and an elastic portion. The buckle portion is coupled to an end of the elastic portion. The buckle portion buckles the second circular body. The elastic portion covers the first base, and the elastic portion produces a deformation along with the floating between the second circular body and the first base. Wherein, the male head is combined with the female seat. The third circular body is inserted between the second circular body and the fourth circular body, so that the second terminal of the third electrode group is electrically coupled to the first terminal of the second electrode group, and the second terminal of the first electrode group is electrically coupled to the first terminal of the fourth electrode group, and the first, second, third and fourth electrode groups are combined with the third circular body by the ring member to block water and dust from the outside.

To achieve the aforementioned and other objectives, the present invention provides a ring member of a waterproof circular connector, and the ring member is applied to a female seat and a second circuit board. Wherein, the female seat comprises a first base, a second circular body, a fourth circular body, a second base, a second electrode group and a fourth electrode group for coupling the second circuit board. Wherein, the fourth circular body, the second circular body and the first base are arranged sequentially from a center point of the female seat to the outside. The ring member of the waterproof circular connector comprises a buckle portion, an elastic portion and a pressing portion. The buckle portion is capable of buckling the second circular body. An end of the elastic portion is coupled to the buckle portion. The elastic portion can cover the first base. The elastic portion produces a deformation along with the floating between the second circular body and the first base. The pressing portion is coupled to the other end of the elastic portion and installable to the second circuit board.

Compared with the prior art, the waterproof circular connector of the present invention provides a convenient non-directional electrical connection, and the circular connector allows more than one hundred terminals (which are the electrodes described in this specification) to be installed in a limited space. In addition, the ring member of the present invention is provided for protecting the terminal and preventing short circuits between the terminals or wrong operations caused by water or dust. Wherein, the present invention can be designed with a ring to provide power transmission and control signal transmission simultaneously, or designed with a different ring to provide independent power transmission and control signal transmission, so that designers can design more terminals for the power and signal transmissions in a limited space to implement the more complicated and higher-end applications.

DESCRIPTION OF THE EMBODIMENTS

The accompanying drawings are included to provide a further understanding of the disclosure, and are incorporated in and constitute a part of this specification. The drawings illustrate embodiments of the disclosure and, together with the description, serve to explain the principles of the disclosure.

In this invention, the terms "a" and "one" are used as a unit, an element and a component for the description of this specification to facilitate the description and provide a general meaning to the scope of the invention, so that both "a" and "one" refer to one or at least one including an odd or even number, unless otherwise specified.

In this invention, the terms "comprising", "including", "having" "containing" or any other similar terminologies intend to cover non-exclusive contents. For example, the invention comprising an element of a plurality of elements, structures, products, or devices is not limited to the elements listed in the specification only, but also including other usually inherent elements, structures, products or devices which are not listed specifically. Unless otherwise specified, the term "or" refers to the inclusive "or", but not the exclusive "or".

Figure 1:
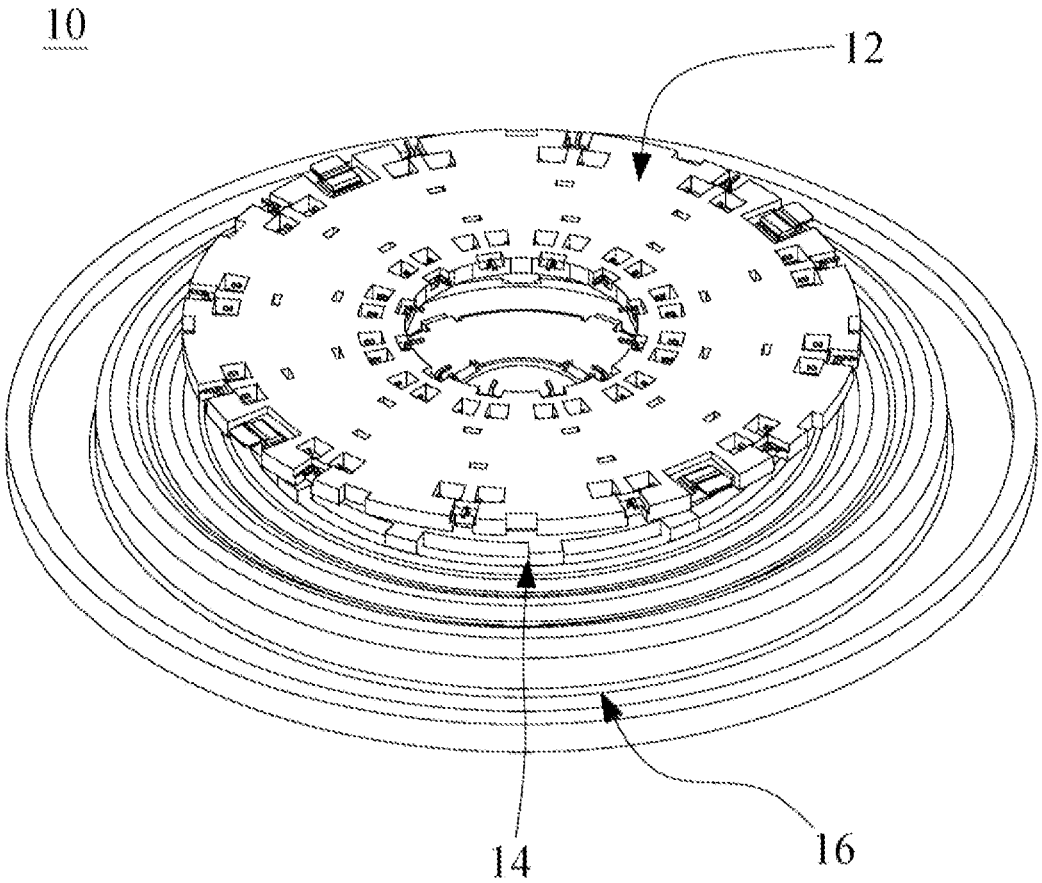
FIG. 1 is a schematic view of a waterproof circular connector in accordance with an embodiment of the present invention.
Figure 2:
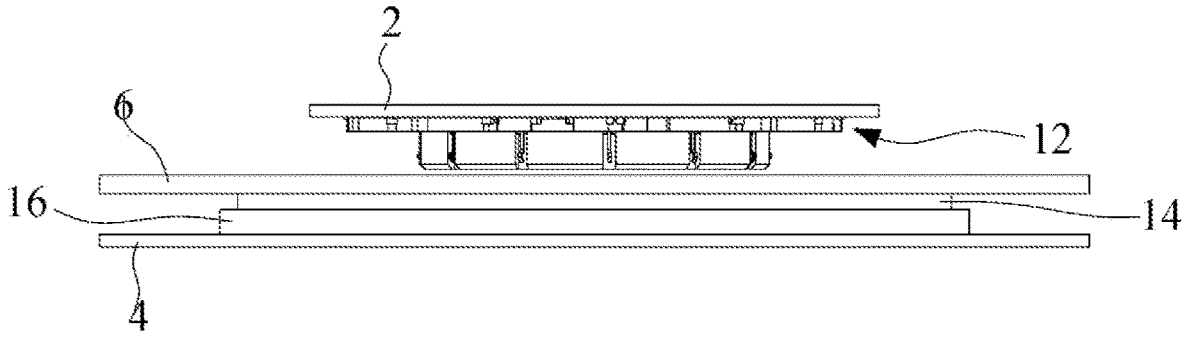
FIG. 2 is a side view showing the connection of the waterproof circular connector in accordance with the present invention as depicted in FIG. 1.

With reference to FIG. 1 for the schematic view of the structure of a waterproof circular connector in accordance with an embodiment of the present invention, the waterproof circular connector 10 is applied to a first circuit board 2 and a second circuit board 4, and their connection method is illustrated in FIG. 2. With reference to FIG. 2 for the side view showing the connection of the waterproof circular connector in accordance with an embodiment of the present invention as depicted in FIG. 1, a portion of a first circuit board 2 which is a display panel (not shown in the figure) and a second circuit board 4 is mounted onto a frame of a wall (not shown in the figure), and a male head 12 disposed on the first circuit board 2 is combined with a disposed on the second circuit board 4, so that the display panel can receive a control signal and a power signal from the female seat 14 through the male head 12 of the first circuit board 2.

The waterproof circular connector 10 comprises a male head 12, a female seat 14 and a ring member 16. In this embodiment, the waterproof circular connector 10 is a circular ring; and in other embodiments, the waterproof circular connector 10 is a ring member such as a rectangular ring, an even-sided polygonal ring, or an odd-sided polygonal ring.

Figure 3:
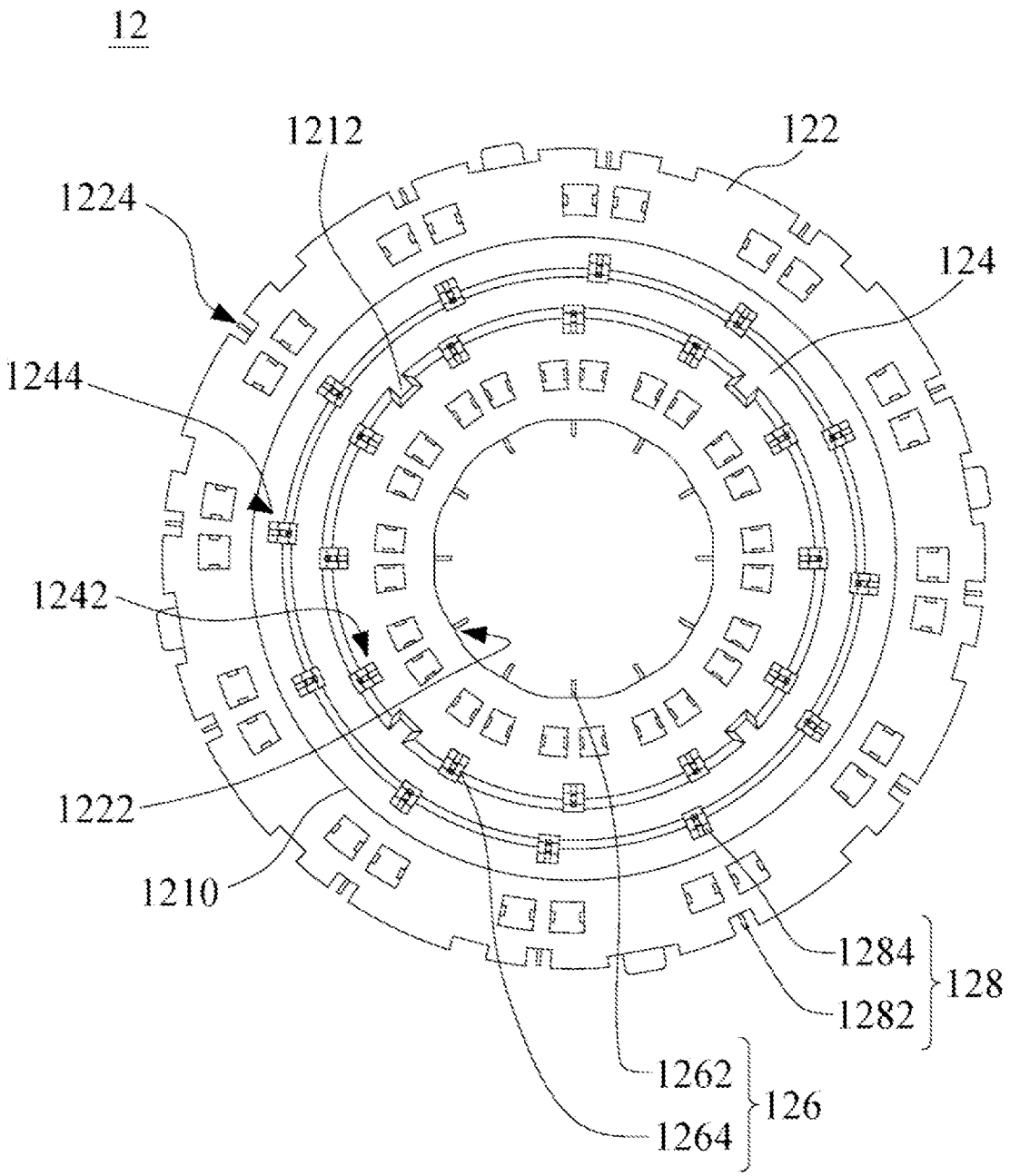
FIG. 3 is a bottom view of a male head in accordance with the present invention as depicted in FIG. 1.

With reference to FIG. 3 for the bottom view of the male head of the present invention as depicted in FIG. 1, the male head 12 in FIG. 2 provides a first circular body 122, a third circular body 124, a first electrode group 126 (including a first terminal 1262 and a second terminal 1264), a third electrode group 128 (including a first terminal 1282 and a second terminal 1284), a first slot 1222, a third slot 1242, a fifth slot 1224 and a seventh slot 1244.

Figure 4:
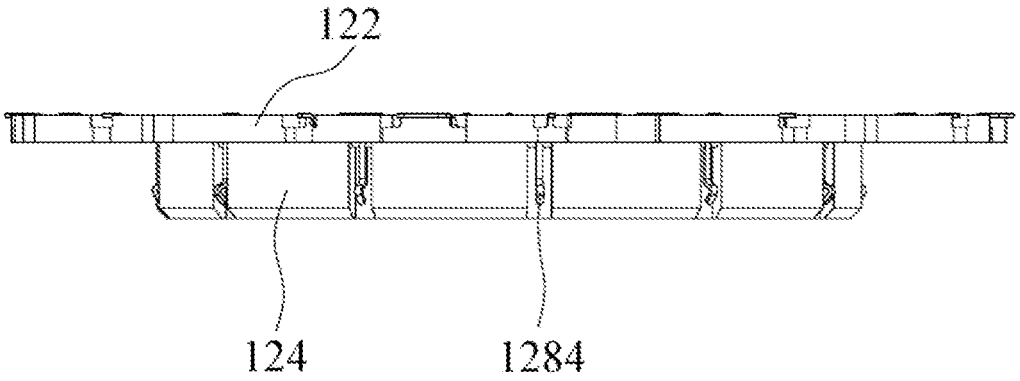
FIG. 4 is a side view of a male head in accordance with the present invention as depicted in FIG. 1.
Figure 5:
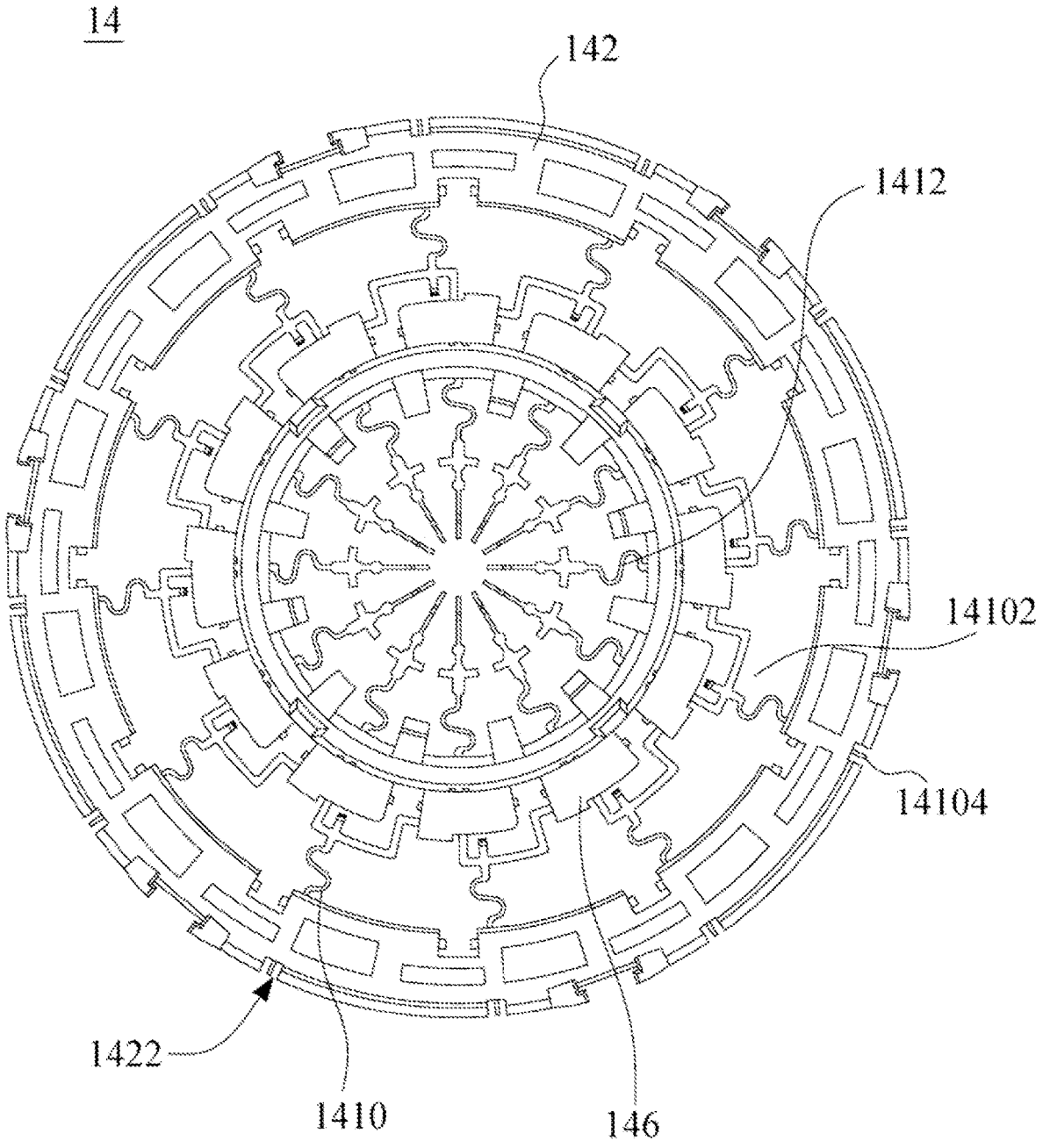
FIG. 5 is a top view showing the portion of a female seat in accordance with the present invention as depicted in FIG. 1.
Figure 6:
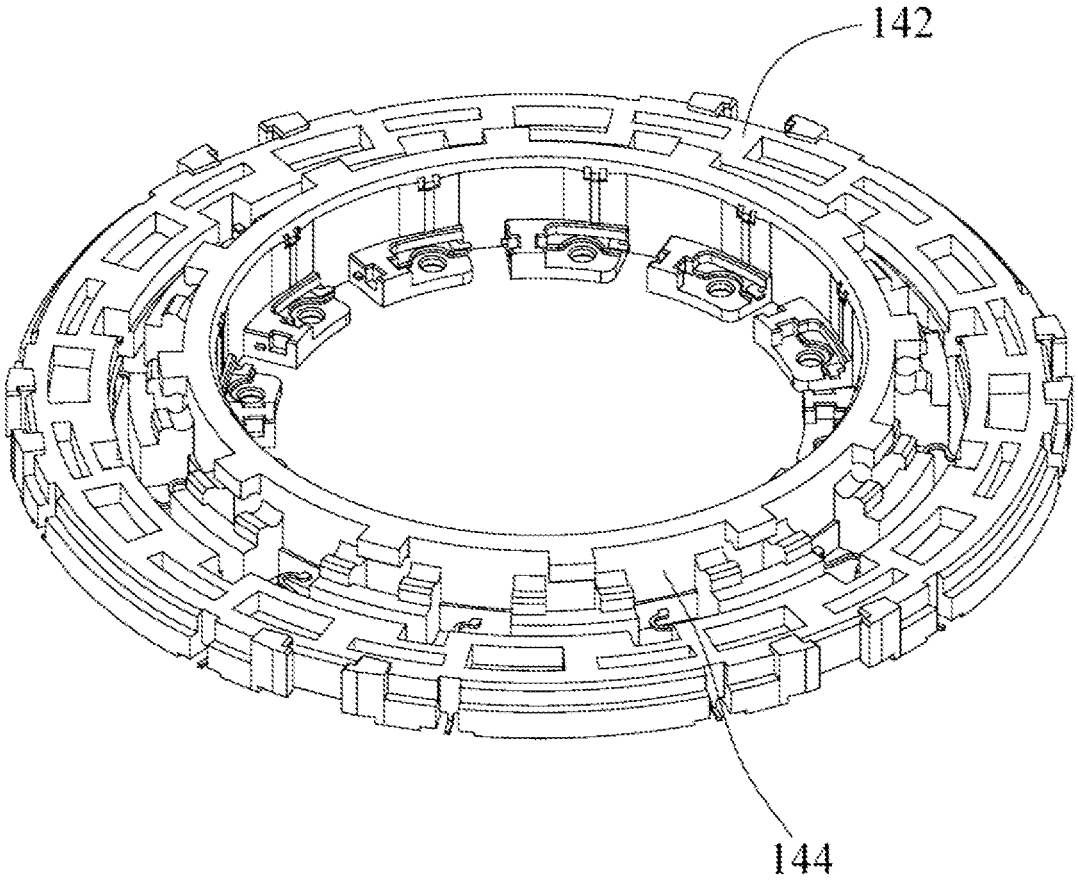
FIG. 6 is an oblique view showing the portion of a female seat in accordance with the present invention as depicted in FIG. 1.
Figure 7:
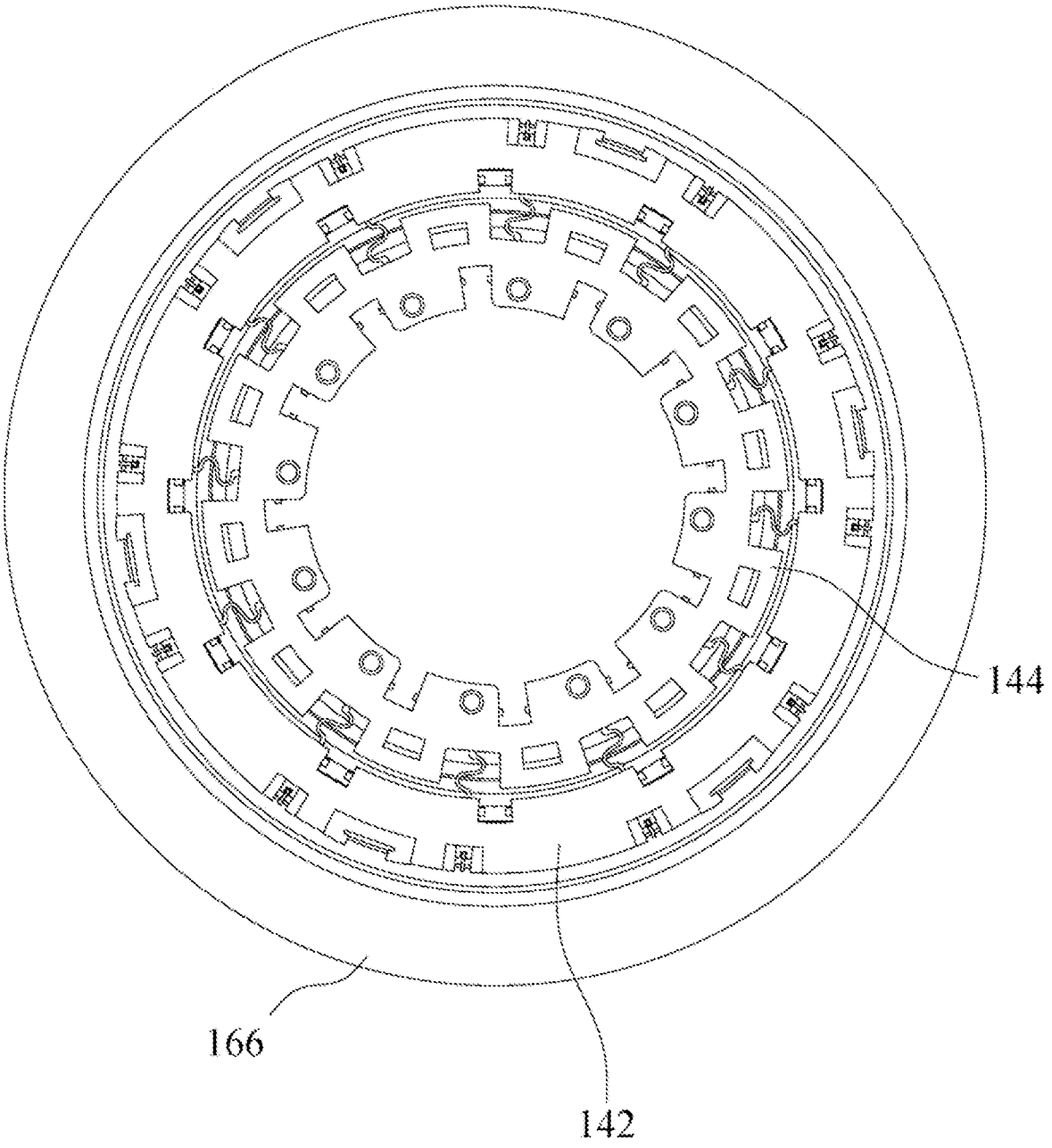
FIG. 7 is a top view of a female seat combined with a ring member in accordance with the present invention as depicted in FIG. 1.

Both of the first circular body 122 and the third circular body 124 are circular rings, and the first circular body 122 has a diameter greater than the diameter of the third circular body 124. In this embodiment, the third circular body 124 is stacked on the first circular body 122, so that the third circular body 124 is protruded from the first circular body 122. FIG. 4 is a side view showing the structure of the male head 12.

In this embodiment, the third slot 1242 and the fifth slot 1224 are configured to be asymmetrical to each other; and in other embodiments, the third slot 1242 and the fifth slot 1224 are configured to be symmetrical to each other. The configuration of the first electrode group 126 and the third electrode group 128 can be changed simultaneously by the configuration of the third slot 1242 and the fifth slot 1224.

Specifically, a fifth slot 1224 is formed at a portion of the outer periphery of the first circular body 122 for installing the first terminal 1282 of the third electrode group 128. Wherein, the first terminal 1282 of the third electrode group 128 is soldered to the first circuit board 2 for receiving a control signal and/or a power signal (not shown in the figure) from the first circuit board 2. In addition, the second terminal 1284 of the third electrode group 128 is passed through the first circular body 122 and exposed from the seventh slot 1244 of the third circular body 124. A first slot 1222 is formed at the inner periphery of the first circular body 122 and provided for installing the first terminal 1262 of the first electrode group 126. The first terminal 1262 of the first electrode group 126 is soldered to the first circuit board 2 for receiving a control signal and/or a power signal (not shown in the figure) from the first circuit board 2.

In addition to the aforementioned seventh slot 1244 formed at the outer periphery of the third circular body 124, the third circular body 124 also has a third slot 1242 formed at its inner periphery. The third slot 1242 is provided for installing the second terminal 1264 of the first electrode group 126.

As described above, the quantity of fifth slots 1224 and seventh slots 1244 can be greater than or equal to the quantity of third electrode groups 128; and the quantity of first slots 1222 and third slots 1242 can be greater than or equal to the quantity of first electrode groups 126.

In this embodiment, a rib ring 1210 surrounding and protruding from the first circular body 122 and disposed proximate to the outer periphery of the third circular body 124 can be added selectively, wherein the rib ring 1210 is slightly higher than the first circular body 122 and at the same level or lower than the third circular body, so that after the male head 12 and the female seat 14 are combined, a dustproof or waterproof effect can be achieved.

In this embodiment, a first positioning structure 1212 protruded from the inner periphery of the third circular body 124 can be added selectively, and the position for installing the first positioning structure 1212 is provided for performing a blind insertion through a predetermined angle such as 0 degree, 90 degrees, 180 degrees and 270 degrees, when the male head 12 and the female seat 14 are combined.

Refer to FIGS. 5 to 8 for the top view of a portion of a female seat, the oblique view of the portion of female seat, the top view of the female seat combined with a ring member, and the oblique view of the female seat combined with the ring member in accordance with the present invention as depicted in FIG. 1.

The female seat 14 provides a first base 142, a second circular body 144, a fourth circular body 146, a second base 148, a second electrode group 1410 and a fourth electrode group 1412. The first base 142 and the second base 148 is fixable to the second circuit board 4. The second base 148, the fourth circular body 146, the second circular body 144 and the first base 142 are arranged sequentially from a center point of the female seat 14 to the outside.

The first base 142 is made of a non-conductive material such as plastic. The first base 142 has a plurality of slots 1422 formed at the outer periphery of the first base 142, and the slots 1422 are configured to be corresponsive to the second slot 1442 of the second circular body 144 to expose a second terminal 14104 of the second electrode group 1410. The second terminal 14104 of the second electrode group 1410 is soldered to the second circuit board 4 for receiving a control signal and/or a power signal (not shown in the figure) from the second circuit board 4. Wherein, the second electrode group 1410 is disposed between the first base 142 and the second circular body 144. In addition to the aforementioned second terminal 14104 exposed from the slots 1422, the second electrode group 1410 also provides a floating structure and a first terminal 14102, and the second electrode group 1410 is made of a conductive material such as metal. Wherein, the floating structure is shaped like the letter S and formed between the first terminal 14102 and the second terminal 14104 of the second electrode group 1410, so that when an external force is acted on the second circular body 144, the deformation of the deformed floating structure changes the offset between the second circular body 144 and the first base 142; and the first terminal 14102 of the second electrode group 1410 is exposed from the second slot 1442 for transmitting a control signal and/or a power signal from the second circuit board 4, and the second slot 1442 is configured to be corresponsive to the seventh slot 1244 of the third circular body 124 as depicted in FIG. 3.

In addition, the second base 148 is made of a non-conductive material such as plastic. The second base 148 has a plurality of slots 1482 formed at the inner periphery of the second base 148, and at the bottom of the second base 148, and the slots 1482 are provided for exposing the second terminal 14124 of the fourth electrode group 1412. The second terminal 14124 of the fourth electrode group 1412 is soldered to the second circuit board 4 for receiving a control signal and/or a power signal (not shown in the figure) from the second circuit board 4. In addition, the fourth electrode group 1412 is disposed between the second base 148 and the fourth circular body 146. In addition to the aforementioned second terminal 14124, the fourth electrode group 1412 further provides a floating structure and a first terminal 14122, and the fourth electrode group 1412 is made of a conductive material such as metal. Wherein, the floating structure is shaped like the letter S and formed between the first terminal 14122 and the second terminal 14124 of the fourth electrode group 1412. When an external force is acted on the fourth circular body 146, the deformation of the deformed floating structure changes the offset between the fourth circular body 146 and the second base 148; and the first terminal 14122 of the fourth electrode group 1412 is exposed from the fourth slot 1462 and provided for transmitting a control signal and/or a power signal from the second circuit board 4, and the fourth slot 1462 is configured to be corresponsive to the third slot 1242 of the third circular body 124 as depicted in FIG. 3.

In this embodiment, the second slot 1442 and the fourth slot 1462 are configured to be asymmetrical to each other; and in other embodiments, the second slot 1442 and the fourth slot 1462 are configured to be symmetrical to each other. The configuration of the second slot 1442 and the fourth slot 1462 simultaneously changes the configuration of the second electrode group 1410 and the fourth electrode group 1412.

The quantity of second electrode groups 1410 in the aforementioned second circular body 144 is greater than or equal to the quantity of fourth electrode groups 1412 in the fourth circular body 146, and the second electrode of the second electrode group 1410 and the fourth electrode of the fourth electrode group 1412 are configured to be symmetrical or asymmetrical to each other.

Besides the quantity and configuration as described above, the first electrode group 126 and the third electrode 128 independently provide a power signal and a control signal, and the second electrode group 1410 and the fourth electrode 1412 independently provide a power signal and a control signal; and the first electrode group 126 or the third electrode group 128 simultaneously provide a power signal and a control signal, and the second electrode group 1410 or the fourth electrode group 1412 simultaneously provide a power signal and a control signal.

Figure 8:
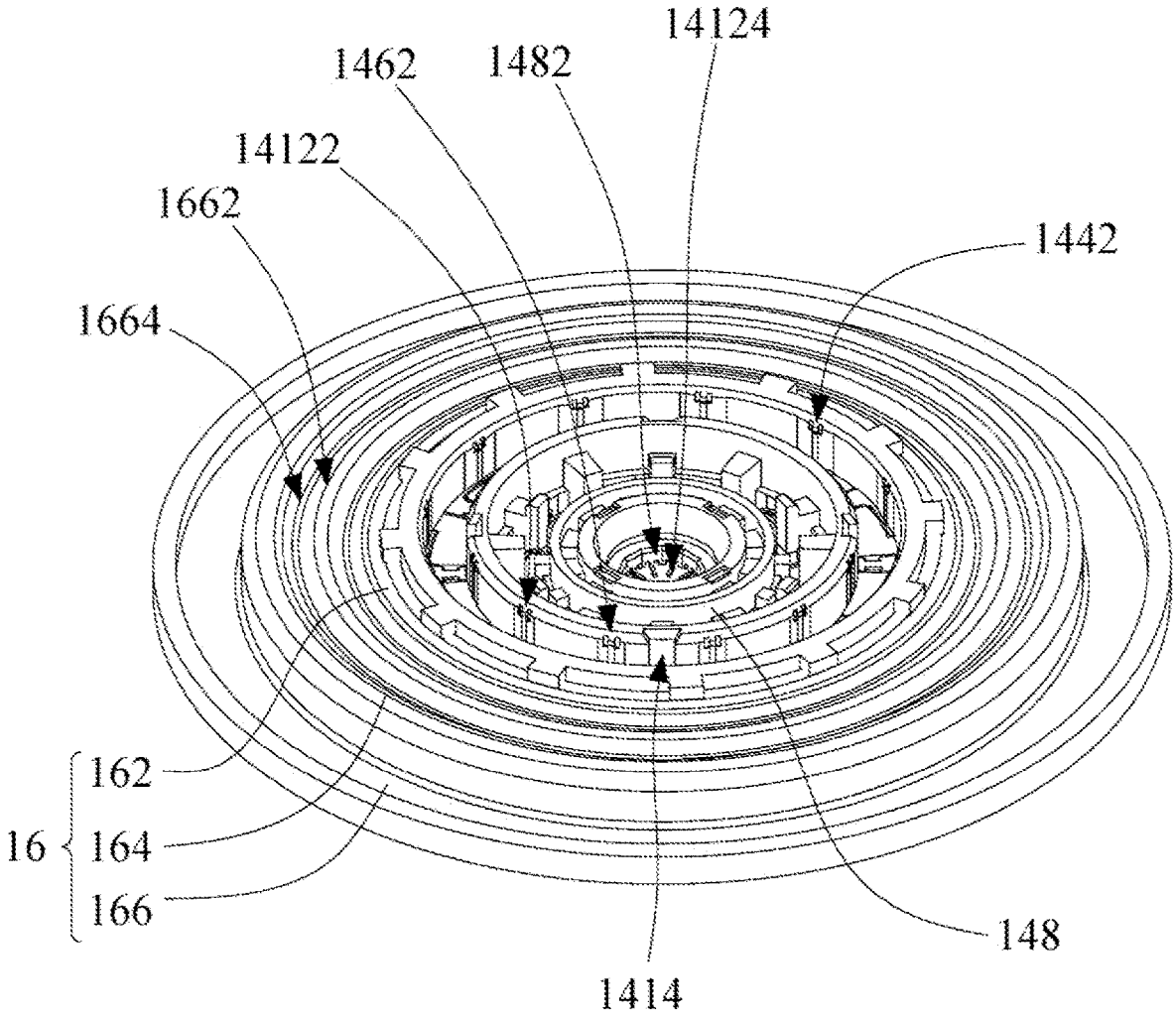
FIG. 8 is an oblique view of a female seat combined with a ring member in accordance with the present invention as depicted in FIG. 1.

Referring to FIG. 8 as well, a second positioning structure 1414 can be added selectively and used for aligning with the first positioning structure 1212, and the second positioning structure 1414 is recessed in the outer periphery of the fourth circular body 124, and the position of the first positioning structure 1212 is provided for performing a blind insertion with a predetermined angle such as 0 degree, 90 degrees, 180 degrees and 270 degrees, when the male head 12 and the female seat 14 are combined. The first positioning structure 1212 is combined with the second positioning structure 1414 to allow the male head 12 to be coupled to the female seat 14 with a predetermined angle.

The ring member 16 comprises a buckle portion 162 and an elastic portion 164, wherein the ring member 16 is in the shape of a circular body for matching the shape of the second circular body and the fourth circular body of the female seat 14. However, in other embodiments, the ring member 16 may be of any shape. The ring member 16 is made of rubber with good elasticity and capable of being stretched and compressed. In addition, the buckle portion 162 is coupled to an end of the elastic portion 164. Wherein, the buckle portion 162 buckles the outer periphery of the second circular body 144.

The elastic portion 164 covers the first base 142, and the elastic portion 164 produces a deformation along with the floating between the second circular body 144 and the first base 142. For example, the elastic portion 164 comprises a wavy structure with a wave crest 1662 and a wave trough 1664 to let the ring member 16 have the features of extension and compression.

In this embodiment, the ring member 16 further selectively provides a pressing portion 166 coupled to the other end of the elastic portion 164 and installable to the second circuit board 4, so that the elastic portion 164 is disposed between the buckle portion 162 and the pressing portion 166. In another embodiment, the cover 6 as shown in FIG. 2 cooperates with the pressing portion 166 to form a pressing strip (not shown in the figure), and the pressing strip is provided for pressing the pressing portion 166 against the second circuit board 4, so that the ring member 16 can be pressed tightly at the second circuit board 4 to achieve the dustproof and waterproof effects.

Figure 9:
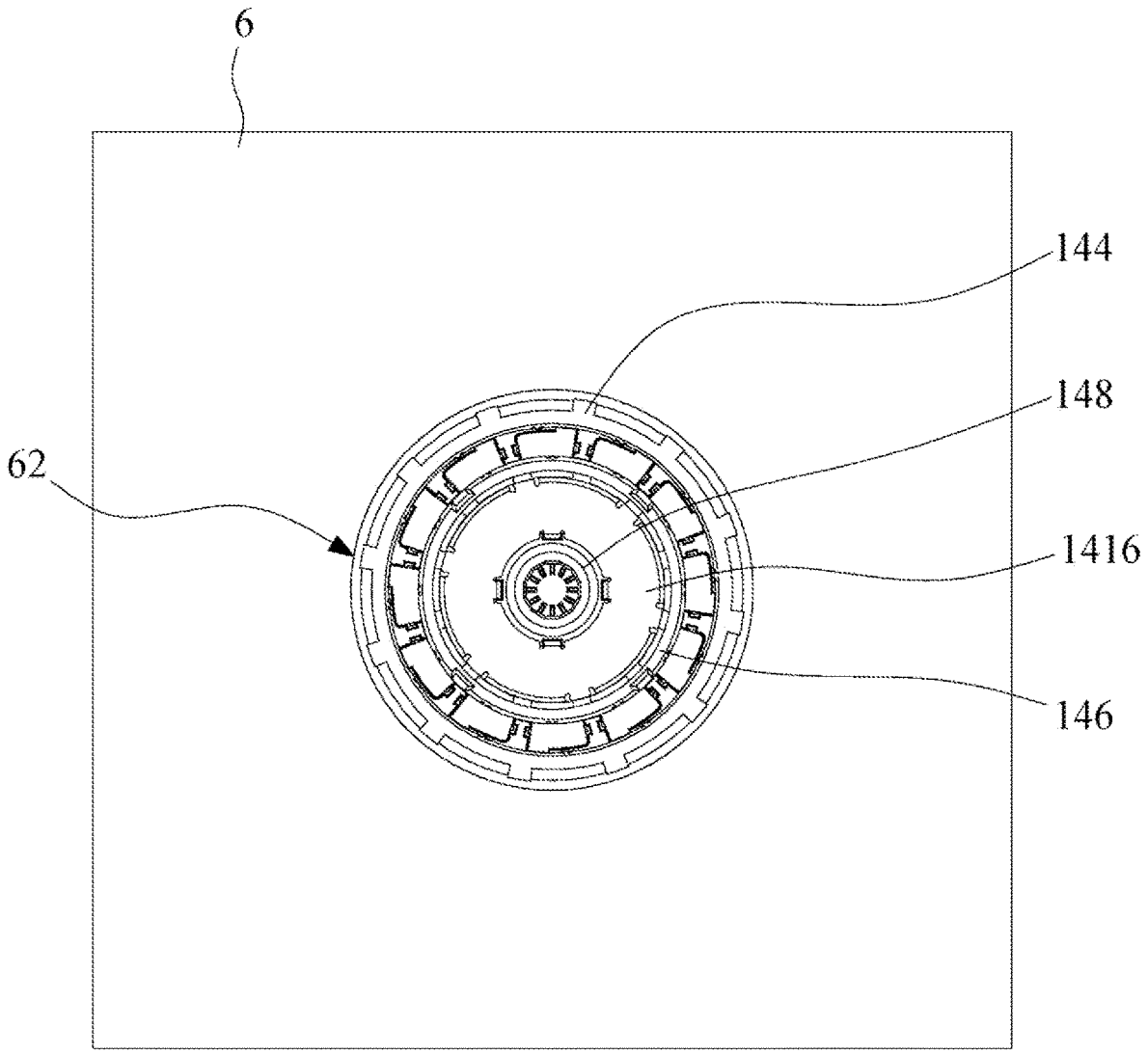
FIG. 9 is a top view of a female seat and a ring member coupled to a cover in accordance with the present invention as depicted in FIG. 1.

With reference to FIG. 9 for the top view of a female seat and a ring member coupled to a cover in accordance with the present invention, the cover 6 has a breach 62 formed thereon for exposing the second ring member 144, the fourth ring member 146, and the second base 148. In another embodiment, the female seat 14 further comprises a cap 1416 installed at the inner periphery of the fourth ring member for covering the fourth electrode group 1412.

What is claimed is:

1. A waterproof circular connector, applied to a first circuit board and a second circuit board, and comprising:

a male head, coupled to the first circuit board, and having a first circular body, a third circular body, a first electrode group and a third electrode group, and the third circular body being stacked on the first circular body;

a female seat, provided for coupling the second circuit board, and having a first base, a second circular body, a fourth circular body, a second base, a second electrode group and a fourth electrode group, and the second base, the fourth circular body, the second circular body and the first base being sequentially arranged from a center point of the female seat to the outside, and the second electrode group being disposed between the first base and the second circular body, and the fourth electrode group being disposed between the fourth circular body and the second base; and a ring member, having a buckle portion and an elastic portion, and the buckle portion being coupled to an end of the elastic portion, and the buckle portion buckling the second circular body, and the elastic portion covering the first base, and the elastic portion producing a deformation along with a floating between the second circular body and the first base;

wherein, the male head is combined with the female seat, and the third circular body is inserted between the second circular body and the fourth circular body, so that a second terminal of the third electrode group is electrically coupled to a first terminal of the second electrode group, and a second terminal of the first electrode group is electrically coupled to a first terminal of the fourth electrode group, and the first electrode group, the second electrode group, the third electrode group, and the fourth electrode group are combined with the third circular body by the ring member to prevent water and dust entering from the outside.

2. The waterproof circular connector as claimed in claim 1, wherein the first circular body has a first slot formed at the inner periphery thereof and provided for installing a first terminal of the first electrode group, and the third circular body has a third slot form at the inner periphery thereof and provided for installing the second terminal of the first electrode group, and the first circular body has a fifth slot formed at the outer periphery thereof and provided for installing a first terminal of the third electrode group, and the third circular body has a seventh slot formed at the outer periphery thereof and provided for installing the second terminal of the third electrode group.

3. The waterproof circular connector as claimed in claim 2, wherein the second circular body has a second slot formed thereon and provided for installing the first terminal of the second electrode group, and the fourth circular body has a fourth slot formed thereon and provided for installing the first terminal of the fourth electrode group, and the second slot is configured to be corresponsive to the seventh slot, and the fourth slot is configured to be corresponsive to the third slot, and at least one of the second electrode group and the fourth electrode group has a floating structure.

4. The waterproof circular connector as claimed in claim 1, wherein the third circular body further comprises a first positioning structure disposed at the inner periphery thereof, and the fourth circular body further comprises a second positioning structure disposed at the outer periphery thereof, and the first positioning structure is combined with the second positioning structure to couple the male head to the female seat with a predetermined angle.

5. The waterproof circular connector as claimed in claim 1, wherein the ring member further comprises a pressing portion coupled to the other end of the elastic portion and provided for being installed to the second circuit board.

6. The waterproof circular connector as claimed in claim 5, further comprising an outer casing with a pressing strip, and the pressing strip being provided for pressing the pressing portion against the second circuit board.

7. The waterproof circular connector as claimed in claim 1, wherein the elastic portion comprises a wavy structure formed thereon and having a wave crest and a wave trough to let the ring member have the features of extension and compression.

8. The waterproof circular connector as claimed in claim 1, wherein the first circular body further comprises a rib ring surrounding around the first circular body and disposed proximate to the outer periphery of the third circular body.

9. A ring member of a waterproof circular connector, applied to a female seat and a second circuit board, wherein the female seat has a first base, a second circular body, a fourth circular body, a second base, a second electrode group and a fourth electrode group coupled to the second circuit board, and the second base, the fourth circular body, the second circular body and the first base are arranged sequentially from a center point of the female seat to the outside, and the ring member of the waterproof circular connector comprises:

a buckle portion, for buckling the outer periphery of the second circular body;

an elastic portion, with an end coupled to the buckle portion, and the elastic portion being provided for covering the first base, and the elastic portion producing a deformation along with a floating between the second circular body and the first base; and a pressing portion, coupled to the other end of the elastic portion, and provided for being installed to the second circuit board.

* * * * *